United States Patent [19]

Hattori

[11] Patent Number: 4,982,682

[45] Date of Patent: Jan. 8, 1991

[54] HULL CONSTRUCTION FOR SMALL WATERCRAFT

[75] Inventor: Tsutomu Hattori, Iwata, Japan

[73] Assignee: Yamaha Hatsudoki Kabushiki Kaisha, Iwata, Japan

[21] Appl. No.: 405,631

[22] Filed: Sep. 8, 1989

[30] Foreign Application Priority Data

Sep. 8, 1988 [JP] Japan ..... 63-225738

[51] Int. Cl.[5] ..... B63B 35/73

[52] U.S. Cl. ..... 114/270; 114/211; 114/363; 440/89

[58] Field of Search ..... 114/270, 211, 363, 182; 440/88, 89

[56] References Cited

U.S. PATENT DOCUMENTS

| | | | |
|---|---|---|---|
| Re. 30,978 | 6/1982 | Jacobson | 114/270 |
| 3,553,750 | 1/1971 | Christensen | 114/357 |
| 3,948,206 | 4/1976 | Tyler | 440/88 X |
| 3,982,497 | 9/1976 | Caron | 114/270 |
| 4,568,293 | 2/1986 | Yazaki | 114/211 X |
| 4,685,582 | 1/1987 | Nishida | 114/360 |
| 4,744,325 | 5/1988 | Nobayashi | 114/270 |

FOREIGN PATENT DOCUMENTS

| | | | |
|---|---|---|---|
| 31595 | 2/1987 | Japan | 114/270 |
| 125984 | 6/1987 | Japan | 114/270 |
| 265797 | 11/1988 | Japan | 114/270 |
| 682199 | 11/1952 | United Kingdom . | |

OTHER PUBLICATIONS

Patent Abstracts of Japan, vol. 11, No. 158(m591) [2605], May 22, 1987; and JP-A-61 291 292 (Yamaha Motor Co., Ltd.) 22-12-1986.

*Primary Examiner*—Sherman Basinger
*Attorney, Agent, or Firm*—Ernest A. Beutler

[57] ABSTRACT

A hull configuration for a small watercraft of the jet propelled type that is designed to accommodate one or more riders seated in straddle fashion on a seat with a pair of depressed foot wells on opposite sides of the seat that extend through the transom of the hull. An elongated cavity is formed in the hull and a pair of transversely spaced apart flotation devices are positioned in the hull to add to its buoyancy whether erect or inverted. A vent system is provided for the cavity for ventilating the engine compartment formed therein and also for insuring against the inclusion of water in significant amounts in the cavity when the watercraft is inverted. An improved flap type check valve is provided in the foot areas for permitting water to drain therefrom and preclude water entry thereto.

17 Claims, 9 Drawing Sheets

HULL CONSTRUCTION FOR SMALL WATERCRAFT

BACKGROUND OF THE INVENTION

This invention relates to a hull construction for a small watercraft and more particularly to an improved buoyancy arrangement for such a hull, a ventilating arrangement for the hull and also a system for draining water from the deck area of the hull.

Obviously, the hull of a watercraft should be buoyant when the watercraft is in its normal upright condition. However, with certain types of watercraft, it is also desirable to insure that the hull will be buoyant even when the watercraft is inverted or capsized. This is particularly true with small sporting type watercraft, particularly those of the jet propelled type, which frequently become displaced during operation. Although the buoyancy of the watercraft and its hull can be assured by providing water tight compartments, this adds significantly to the cost of the watercraft and, furthermore, provides areas that cannot be used for other purposes and thus is not practical with small sporting type watercraft of the type described. Also, it is not practical to seal all of the compartments of a watercraft since many of the compartments require the admission of outside air and the exhaust of gases from the compartment. For example, the engine compartment cannot be fully sealed because intake air must be supplied for the engine and some means must be provided so as to exhaust the combustion products from the engine. A device has been proposed for attempting to employ the engine compartment as a buoyancy device by the provision of a vent tube that extends into the engine compartment and which is disposed so that its ends are not submerged either when the hull is in its normal position or in an inverted position. Although in principle this sounds desirable, in practice it is quite difficult to achieve.

It is, therefore, a principal object of this invention to provide an improved buoyancy arrangement for the hull of a small watercraft.

It is a further object of this invention to provide a hull for a small watercraft that has several different types of buoyancy increasing devices so as to insure that the hull will be buoyant either in its normal position or in an inverted position.

In addition to supplying air to the engine for its combustion and discharging the exhaust gases from the engine, it is further desirable to provide additional air ventilation for the engine compartment. That is, it is desirable to insure that there is some continuous form of air circulation through the engine compartment in addition to the air that is consumed by the engine for its combustion. Such ventilation of the engine compartment will remove unwanted vapors from the engine compartment and also will insure an adequate engine cooling and cooling of the other components in the engine compartment which do not have their own cooling systems.

It is, therefore, a still further object of this invention to provide an improved arrangement for ventilating the engine compartment of a small watercraft.

It is a further object of this invention to provide an improved ventilating arrangement for a small watercraft of the jet propelled type.

As has been previously noted, certain sporting type of watercrafts are designed so that they may readily capsize in use. It has been found that the righting of a capsized watercraft can be significantly accommodated if the rider's foot area opens through the transom of the watercraft. In this way, if the watercraft becomes capsized and the hull and rider's foot area becomes filled with water, it is possible to drain the water from the hull when righting the watercraft so as to facilitate reentry. However, when the foot area opens through the transom of the watercraft, there is the possibility that water can enter into the foot area during normal vessel operation. Although this type of watercraft has sporting characteristics, it is also desirable to insure that the watercraft can be operated without the riders becoming wet if they do not choose to become wet.

In order to permit the use of the foot area as a drain for the water and also so as to insure that water will not enter the foot area during normal operation, there have been proposed arrangements wherein there is a small dam at the rear of the foot area and a one-way check valve will permit water to flow out of the foot area through the transom of the hull but not return. This has considerable advantages and it is a further object of this invention to provide an improved and simplified dam and check valve assembly for this purpose.

SUMMARY OF THE INVENTION

A first feature of this invention is adapted to be embodied in a hull for a small watercraft that is comprised of a lower portion that is adapted to be at least partially submerged in the water when the hull is in its normal orientation in the water. A deck is secured to the lower portion and defines with the lower portion a longitudinally extending cavity. A pair of transversely spaced floatation devices extend longitudinally along the hull on opposite sides of the cavity. A vent pipe extends through the hull and into the cavity and has open opposite ends. The upper end of the vent pipe lies above the water level when the hull is in its normal upright state and the lower end of the vent pipe also lies above the water level when the hull is inverted and even when the cavity is partially flooded.

Another feature of the invention is also adapted to be embodied in a hull for a small watercraft that includes means defining an engine compartment. An air inlet vent is provided that extends through the hull from an above the water position and terminates in the engine compartment for admitting ventilating and combustion air to the compartment. An air outlet vent also extends through the hull from the engine compartment for exhausting the ventilating air from the engine compartment. The air inlet and air outlet vents are disposed so that there will be a natural flow of air through the engine compartment as the watercraft travels through the water.

A further feature of the invention is also adapted to be embodied in a hull for a small watercraft that includes a rider's area that is adapted to accommodate at least a single rider seated in straddle fashion. A pair of foot wells are disposed on opposite sides of the hull and into which the rider's feet may extend. These foot wells open through the transom of the hull so as to facilitate water draining therefrom. Dams are provided at the rear ends of the foot wells and have a pair of vertically extending sides that define a water discharge opening that permits water to flow from the foot wells rearwardly. A top piece spans these walls and carries a resilient flap that forms a check valve for controlling the flow between the walls.

DETAILED DESCRIPTION OF THE PREFERRED EMBODIMENT

Figure 1:
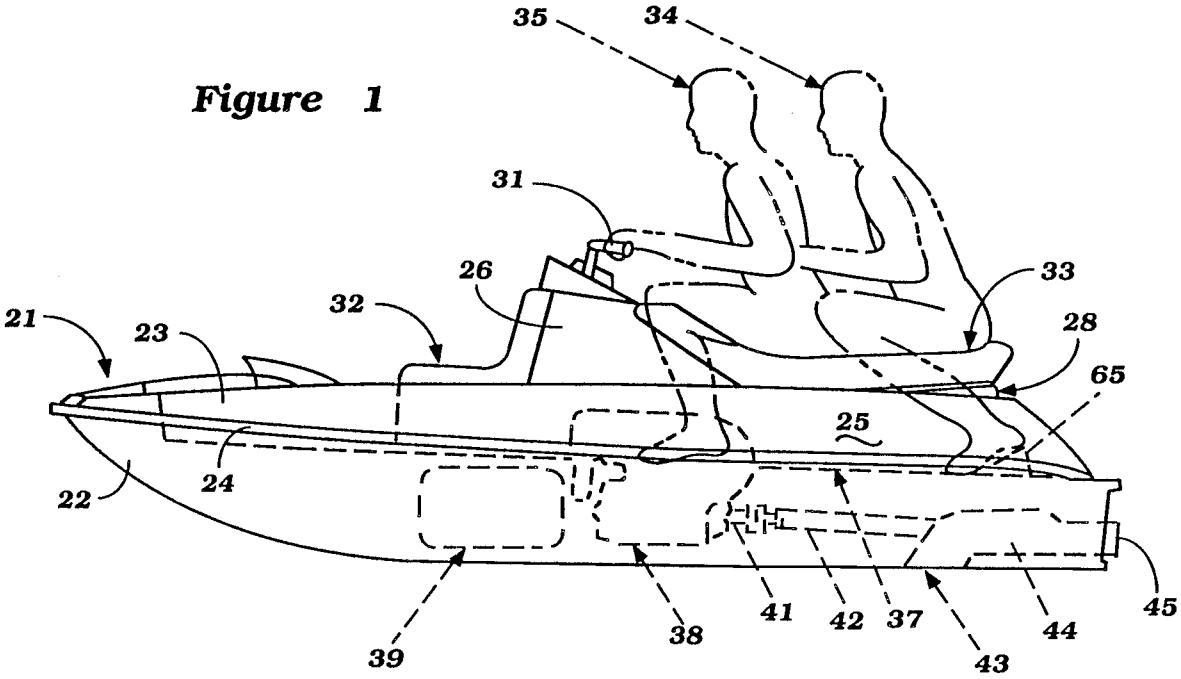
FIG. 1 is a side elevational view of a small watercraft constructed in accordance with an embodiment of the invention.
Figure 2:
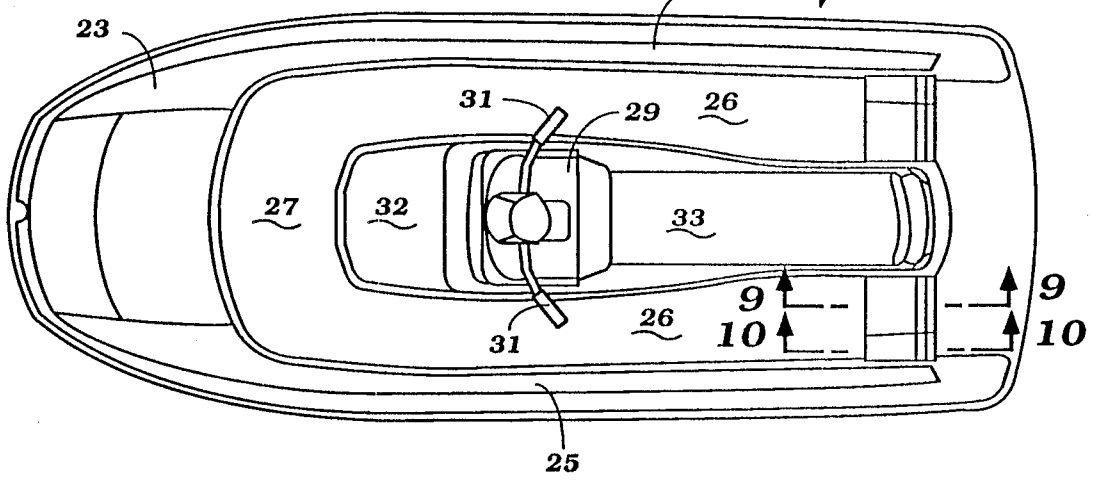
FIG. 2 is a top plan view of the small watercraft.
Figure 3:
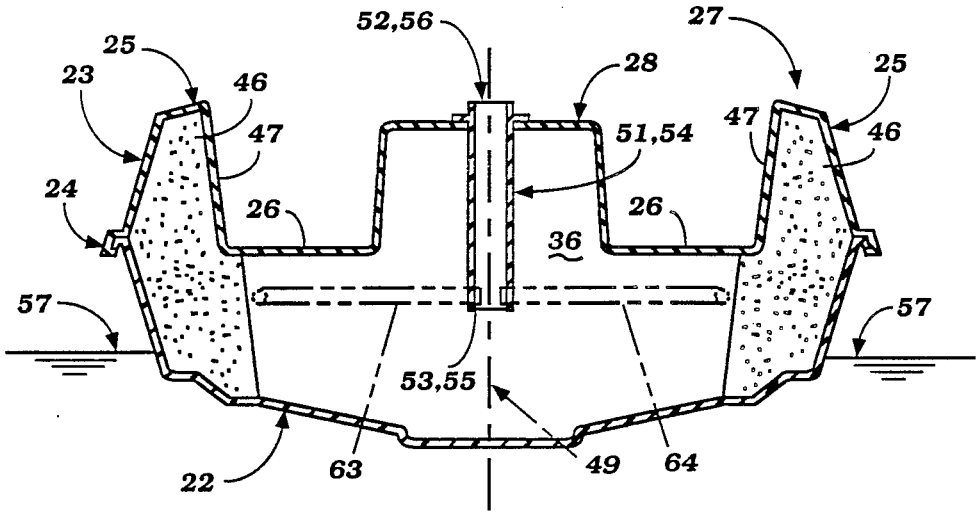
FIG. 3 is a typical cross-sectional view taken through the small watercraft and specifically through the center line of the vent pipes therefor.
Figure 4:
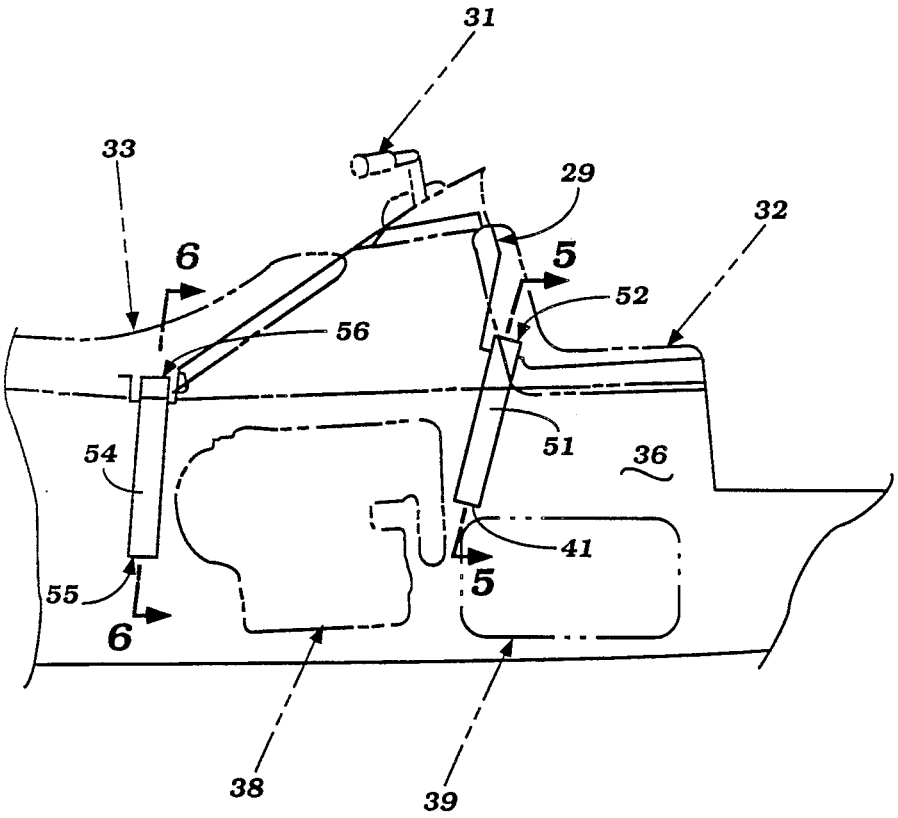
FIG. 4 is an enlarged side elevational view of the watercraft showing the engine compartment and ventilating arrangement for it.
Figure 5:
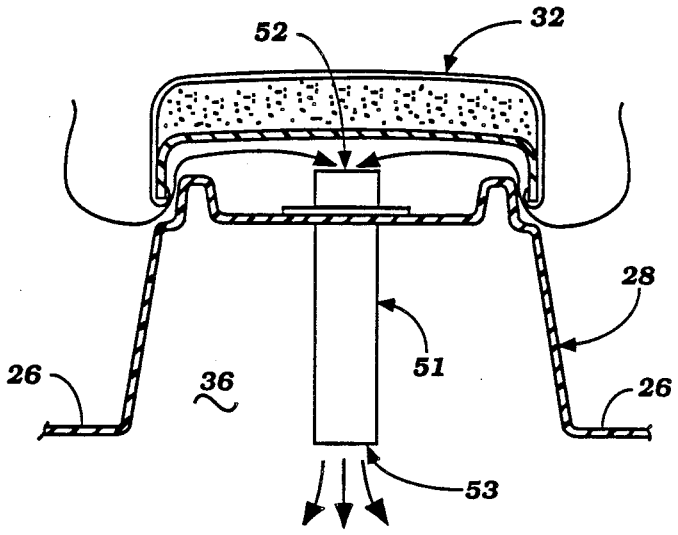
FIG. 5 is an enlarged cross-sectional view taken along the line 5—5 of FIG. 4.
Figure 6:
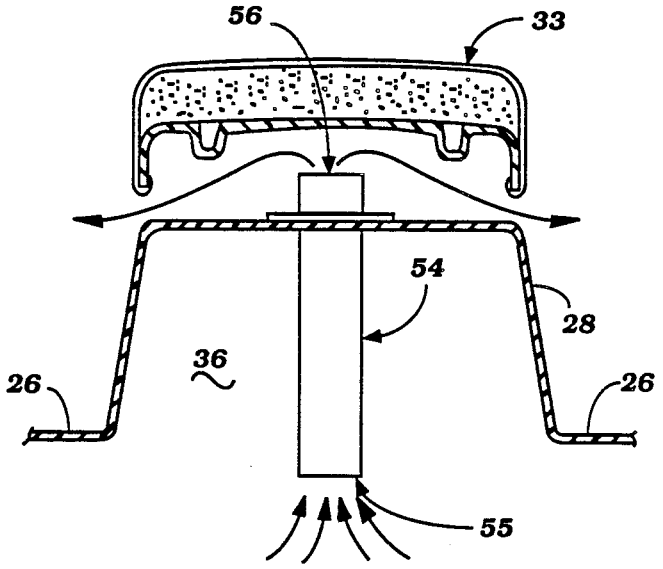
FIG. 6 is an enlarged cross-sectional view taken along the line 6—6 of FIG. 4.

Referring now in detail to the drawings and initially primarily to FIGS. 1 and 2, a small watercraft constructed in accordance with an embodiment of the invention is identified generally by the reference numeral 21. The watercraft 21 is comprised of a hull consisting of a lower hull part 22 and a deck 23 that is affixed to the lower hull part 22, for example, by means of an interlocking flange structure 24 as best shown in FIG. 3. The deck 23 and lower hull part 22 may be conveniently formed from a molded fiberglass reinforced resinous plastic material of the type normally used for such watercraft.

The deck 23 is provided with a pair of upstanding gunnels 25 that extend along on opposite sides of a pair of foot areas 26 which extend rearwardly from a forwardly positioned foot area 27. In top plan, the foot areas 26 and 27 define generally an elongated C-shape, for a reason to be described. It should be noted that the foot areas 26 open through the rear end of the transom of the watercraft so that water can drain out under conditions to be described.

The deck 23 is formed with a raised central area 28 that is bounded on the sides by the foot areas 26 and on the front by the foot area 27. The raised portion 28 defines a bridge 29 that mounts a handlebar assembly 31 for steering of the watercraft in a manner to be described. Forwardly of the bridge 29 there is provided a front seat 32 that is adapted to accommodate a single rider. Behind the bridge 29 is provided a rear seat 33 on which the rider may sit behind the driver in a straddle fashion when traveling as shown by the phanton line views 34 and 35 in FIG. 1. When the watercraft is stationary, the rider 34 may move to the front seat 32 and the watercraft will be stable. This seating arrangement and general hull configuration is described in copending application entitled "Compact Planing Type Boat", Ser. No. 237,505, filed Aug. 26, 1988, in the name of Noboru Kobayashi, which application is assigned to the assignee hereof now issued as U.S. Pat. No. 4,893,579 on Jan. 16, 1990.

The hull and specifically the lower portion 22 and deck 23 define a generally longitudinally extending cavity 36 behind and beneath which is formed a tunnel portion 37 that is formed in the bottom of the hull lower part 22. The cavity 36 houses the main running components of the watercraft 31 such as the powering internal combustion engine 38, which may be of any known type, and other engine accessories such as the fuel tank 39, The engine 38 drives an output shaft 41 that extends through the tunnel 37 and which is coupled to the input shaft 42 of a jet propulsion unit, indicated generally by the reference numeral 43. The jet propulsion unit 43 has a downwardly facing water inlet, a compressor portion .44 and a pivotally supported steering nozzle 45 that is steered by the steering handlebar 31 in a known manner. The actual construction of the running components of the watercraft 21 may be considered to be conventional and since these units per se form no part of the invention, a detailed description of them is believed to be unnecessary.

In accordance with a feature of the invention, a portion of the cavity 36 at the peripheral outer edges of the hull is filled with a buoyant material such as a foamed plastic, indicated generally by the reference numeral 46. The buoyancy material 46 may be foamed in place and extends from the lower portion of the hull vertically upwardly to the area of the gunnels 25 on opposite sides of the foot areas 26 between vertically upwardly extending walls 47 that define the peripheral edges of the foot wells 26. This upward vertical extent improves the buoyance of the hull even in the event the hull becomes inverted as will be described. Because the buoyant masses 46 are disposed at the outer peripheral edges of the hull, they do not occupy any significant usable space of the hull and it is still possible to locate all of the major components of the engine and drive arrangement within the cavity 36. In addition, the center of mass of these components can be located along a longitudinal center plane 49 (FIG. 3) of the watercraft so as to maintain good stability. Also, the outward placement of the buoyant masses 46 also insures that the watercraft will be quite stable.

A ventilating system is provided for ventilating the cavity 36 and primarily the area containing the engine 38. This ventilating system may be best understood by reference to FIGS. 3 through 6. The ventilating system includes a ventilating air inlet conduit 51 that extends in a generally vertical direction and which has an inlet opening 52 that is positioned forwardly of the bridge 29 and beneath the seat 32. By providing the inlet opening 52 beneath the seat 32, it is possible to insure that water cannot be inadvertently drawn into the ventilating pipe 51. The lower end of the ventilating pipe 51 has a discharge opening 53 that is positioned above the floor of the cavity 36 and in a location so that if the watercraft becomes inverted, that the opening 53 will be above the water level with the normal amount of water flowing into the cavity as might be expected. Thus, a quantity of air will be trapped within the hull cavity 36 which will further increase the buoyancy and insure that the watercraft will not sink even if inverted.

The air drawn through the ventilating air inlet conduit 51 is also adequate for engine combustion and furthermore provides a cooling air flow through the engine compartment and cavity 36.

There is further provided a rearwardly positioned ventilating air outlet conduit 54 which also extends vertically from a lower inlet opening 55, which is also positioned above the expected water level if the watercraft becomes inverted. A ventilating air outlet opening 56 lies beneath the rear seat 33 so as to insure that water cannot be inadvertently drawn into the cavity 36 through the ventilating air outlet conduit 54. In addition, the conduits 51 and 54 are disposed in such a way that the travel of the watercraft through the body of water will tend to cause a positive flow through the cavity 36.

Figure 7:
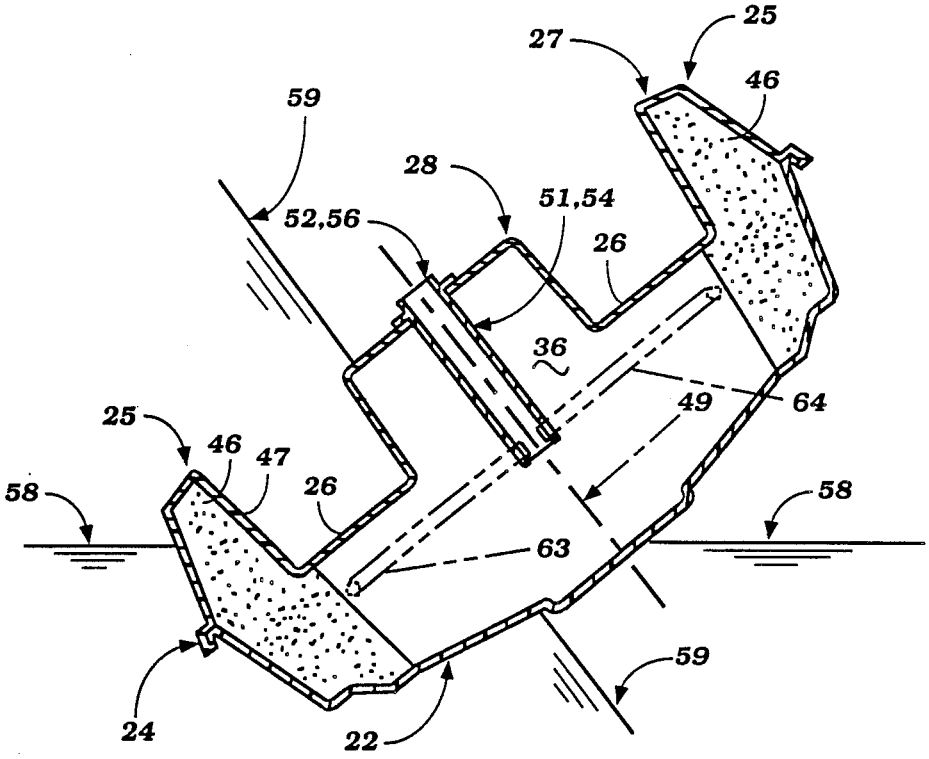
FIG. 7 is a cross-sectional view, in part similar to FIG. 3, showing the watercraft in a tilted condition and also showing the watercraft in a condition where it is about to capsize.
Figure 8:
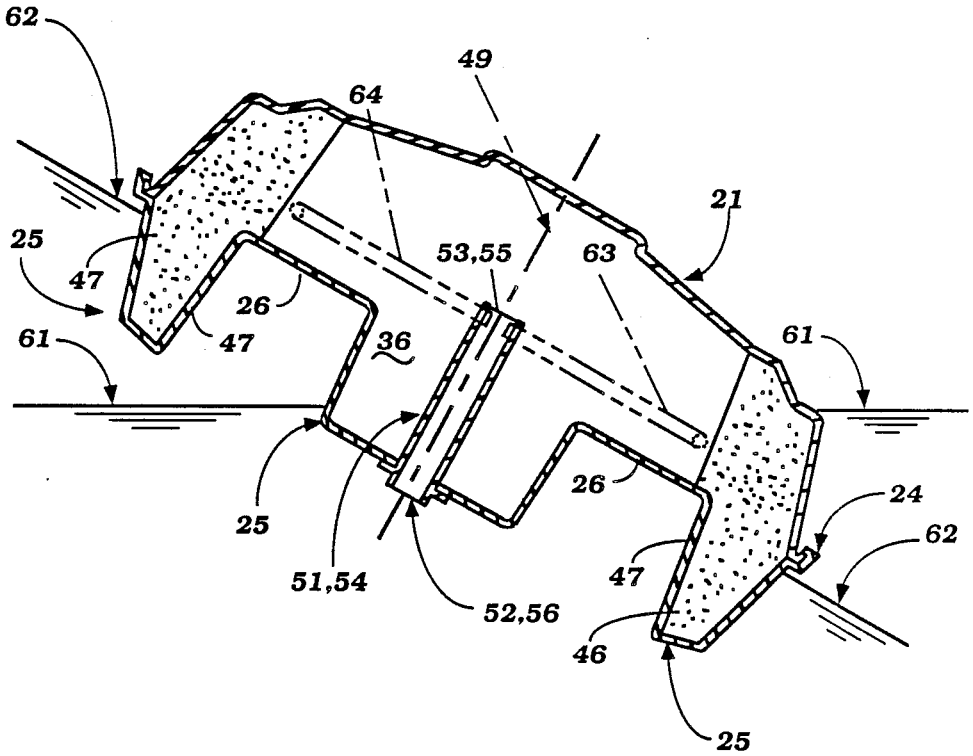
FIG. 8 is a view in part similar to FIG. 7, showing the further movement toward the capsized position and in a fully capsized position.

The way in which the buoyancy of the hull operates so as to prevent overturning and also to insure that the watercraft will remain afloat even when overturned may be best understood by reference to FIGS. 3, 7 and 8 wherein the watercraft is shown in its normal erect position (FIG. 3), when it starts to capsize (FIG. 7) and when it continues and reaches a fully capsized position (FIG. 8). The normal water level when the watercraft is operating in the straight ahead position and under normal floatation is indicated by the line 57 in FIG. 3. If something causes the watercraft to begin to rock or roll over, the hull will assume first a position relative to the water line shown at 58 in FIG. 7 and then a partially tipped over or on its side position as shown by the water line 59. Of course, the buoyancy of the hull and the buoyant masses 46 will tend to resist such overturning movement. In addition, the air that is trapped within the hull will tend to resist this movement and no water can enter into the cavity 36 until the watercraft reaches a position as shown in FIG. 8 wherein the water level is shown at 61 and the vent openings 52 and 56 are now submerged. However, air will tend to be trapped in the cavity 36 and prevent too great a water entry. When the watercraft is fully inverted, the water line will appear at 62 and it will be noted that the vent openings 53, 55 are still positioned substantially above the water level so as to maintain air trapped in the cavity 36 and increase buoyancy.

In order to provide further assurance against excess water trappage in the cavity 36, lateral vent pipes 63 and 64 may extend from the lower ends of the vent pipes 51 and 54.

When the inverted watercraft 21 is again returned to its upright condition, the rearward opening of the foot wells 26 through the transom permits water to flow out of the foot wells so as to assist in the righting movement. However, it is important to insure that the foot area 26 is dry during normal running. To this end, there are provided a pair of raised ramps 65 at the end of each foot well which ramps 65 offer both a foot rest for the rear rider 34 and also are high enough so as to prevent water from entering the foot well area. However, it is also important that any water that does enter this area when the watercraft is inverted can be easily drained out, for the reasons as aforenoted. To this end, there is provided a water return passageway in which a check valve is positioned so as to permit water to flow from the foot well area 26 outwardly from the transom but not in the opposite direction.

Figure 9:
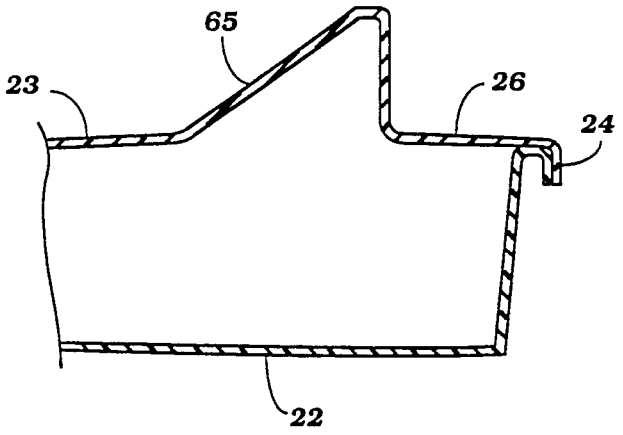
FIG. 9 is an enlarged cross-sectional view taken along the line 9—9 of FIG. 2.
Figure 10:
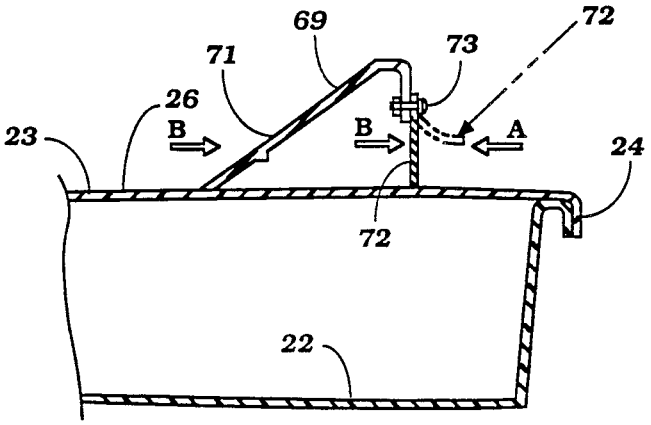
FIG. 10 is a cross-sectional view taken along the line 10—10 of FIG. 2.
Figure 11:
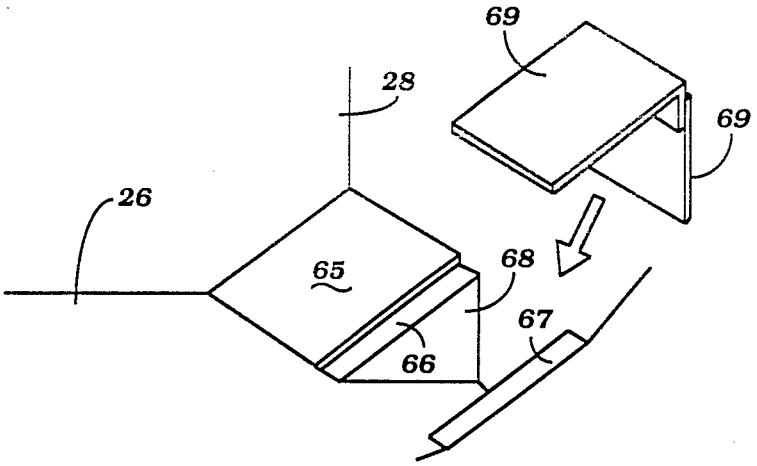
FIG. 11 is a perspective view showing the construction of the drain arrangement for the foot areas.

Referring to FIGS. 9 through 11, it will be noted that the ramps 65 have spaced apart shoulders 66 and 67 that are defined at the inner ends of a pair of spaced apart walls, only one of which 68 appears in FIG. 11. This area between the walls 68 forms a water passageway. A combined closure and valve plate assembly consisting of a closure plate 69 is slidably supported on the surfaces 66 and 67 and is shorter in length than the surfaces so as to define an opening 71 through which water may flow. The plate 69 is affixed to the surfaces 66 and 67 by an epoxy resin and carries a resilient valve member 72 at its rear edge which is held in place by rivets or fasteners 73. The valve members 72 normally assume a closed position so as to preclude water flow as shown in the solid line view of FIG. 10. Any water pressure in the direction of the arrow A will, thus, be precluded from entering into the foot well area. However, on righting motion, when the water pressure acts in the direction of the arrows B, the valve 72 may move to its opened position as shown in the phantom line position so as to permit the water to drain.

It should be readily apparent that the described watercraft construction provides a buoyant hull that will be buoyant either when the watercraft is erect or inverted and also wherein an adequate ventilating system is provided for the engine compartment. In addition, an improved and simplified water drain is incorporated so as to permit water to drain from the foot well areas upon righting but which will preclude water entry from the foot well areas during normal operation. Although an embodiment of the invention has been illustrated and described, various changes and modifications may be made without departing from the spirit and scope of the invention, as defined by the appended claims.

I claim:

1. A hull for a small watercraft comprised of a lower portion adapted to be at least partially submerged in the water when said hull is in its normal orientation in the water, a deck secured to said lower portion and defining outer sides and with said lower portion a longitudinally extending cavity, a pair of transversely spaced flotation devices extending longitudinally along said hull on opposite sides of said cavity and extending vertically toward the upper portion of the hull, means providing a riding area for a rider seated in straddle position on said deck above and to the rear of the front thereof, said hull being defined by foot well portions in which the feet of the rider can be positioned, said flotation devices extending along said upwardly of the foot well portions and terminating at the upper ends of the outer sides of said deck, an engine positioned within said cavity centrally of said hull in the longitudinal direction, and a vent pipe extending through said hull and into said cavity, said vent pipe having open opposite ends for supplying cooling and circulating air to said engine, the upper end of said vent pipe lying above the water level when said hull is in its normal upright condition and the lower end of said vent pipe lying above the water level when said hull is inverted.

2. A hull as set forth in claim 1 wherein the engine drives a jet propulsion unit positioned beneath the lower portion of the hull and the rider.

3. A hull as set forth in claim 2 wherein the vent pipe comprises an intake vent pipe and further including an exhaust vent pipe for exhausting gases from the cavity, said exhaust vent pipe having open opposite ends which are above the water level when the watercraft is either upright or inverted.

4. A hull as set forth in claim 3 wherein the floatation devices are comprised of foamed plastic.

5. A hull as set forth in claim 3 wherein the inlet vent pipe is positioned forwardly of the cavity and the exhaust vent pipe is positioned rearwardly thereof.

6. A hull as set forth in claim 1 wherein the vent pipe has its upper end opening into an area beneath a seat carried by the hull and on which a rider is adapted to be seated.

7. A hull as set forth in claim 1 wherein the vent pipe lies on substantially the longitudinal center line of the hull.

8. A hull as set forth in claim 7 wherein the vent pipe has its upper end opening into an area beneath a seat carried by the hull and on which a rider is adapted to be seated.

9. A hull for a small watercraft comprised of a lower portion adapted to be at least partially submerged in the water when said hull is in its normal orientation in the water, a deck secured to said lower portion and defining with said lower portion a longitudinally extending cavity, a pair of transversely spaced flotation devices extending longitudinally along said hull on opposite sides of said cavity and extending vertically toward the upper portion of the hull, an engine positioned within the said cavity, means providing a riding area for a rider seated in straddle position on the deck above and to the rear of the engine, said hull being defined by foot well portions in which the feet of the rider can be positioned, said flotation devices extending upwardly of the foot well portions and terminating at the upper ends of said foot well portions, a jet propulsion unit positioned beneath the lower portion of said hull and the rider and driven by said engine, an intake vent pipe extending through said hull into the forward position of said cavity for admitting air to said cavity, and an exhaust vent pipe extending through said hull into said cavity rearwardly of said intake pipe having open opposite ends which are above the water level when the watercraft is either upright or inverted, at least one of said vent pipes has its upper end positioned beneath a seat for precluding the entry of water into the cavity when the watercraft is in its normal condition.

10. A hull as set forth in claim 9 wherein both of the vent pipes are positioned beneath a seat.

11. A hull as set forth in claim 10 wherein at least one of the vent pipes has a pair of transversely extending pipes formed at its cavity end which extend toward opposite sides of the cavity and terminate adjacent the respective floatation device.

12. A hull for a small watercraft comprised of a lower portion adapted to be at least partially submerged in the water when said hull is in its normal orientation in the water, a deck secured to said lower portion and defining with said lower portion a longitudinally extending cavity, a pair of transversely spaced flotation devices extending longitudinally along said hull on opposite sides of said cavity and extending vertically toward the upper portion of the hull, a vent pipe extending through said hull and into said cavity, said vent pipe having open opposite ends, the upper end of said vent pipe lying above the water level when said hull is in its normal upright condition and the lower end of said vent pipe lying above the water level when said hull is inverted, said vent pipe having a pair of transversely extending pipes formed at its cavity end which extend toward opposite sides of the cavity and each of which terminate adjacent the respective flotation device.

13. A hull construction for a small watercraft comprised of a lower portion adapted to be at least partially submerged in the water and a deck portion affixed to said lower portion and defining a longitudinally extending cavity, an internal combustion engine disposed within said cavity, an inlet vent pipe extending through said deck from an inlet opening above said deck to an outlet below said deck and within said cavity for admitting air for ventilation and engine combustion to said cavity, and an exhaust vent pipe extending from an inlet opening in said cavity through said deck to an outlet opening positioned above said deck, said inlet pipe being positioned forwardly of the hull and said exhaust pipe being positioned rearwardly of said hull for promoting flow through said cavity upon travel of the watercraft through the water, at least one of said vent pipes having its upper end positioned beneath a seat for precluding the entry of water into the cavity when the watercraft is in its normal condition.

14. A hull as set forth in claim 13 wherein both of the vent pipes are positioned beneath a seat.

15. A hull as set forth in claim 14 wherein at least one of the vent pipes has a pair of transversely extending pipes formed at its cavity end which extend toward opposite sides of the cavity.

16. A hull as set forth in claim 13 wherein at least one of the vent pipes has a pair of transversely extending pipes formed at its cavity end which extend toward opposite sides of the cavity.

17. A hull for a small watercraft having a deck portion defining a seat bounded by a pair of foot areas to receive the feet of a rider seated upon said seat in straddle position, said foot areas opening through the rear of the transom of said hull for permitting water to flow from said foot areas when the hull is being righted, a pair of ramps formed at the ends of said foot area and configured so as to preclude water entry into said foot area, said ramps each defining an opening by a pair of spaced surfaces defining shoulders at their upper ends, a combined closure member and valve plate comprising a rigid member affixed to said shoulders and defining a water flow gap, and a flap type check valve depending therefrom and forming a closure for precluding water entry to said foot areas and for opening to permit water to drain from said foot areas.

* * * * *

UNITED STATES PATENT AND TRADEMARK OFFICE

CERTIFICATE OF CORRECTION

PATENT NO. : 4,982,682

DATED : January 8, 1991

INVENTOR(S) : Tsutomu Hattori

It is certified that error appears in the above-identified patent and that said Letters Patent is hereby corrected as shown below:

On the Title Page under "U.S. Patent Documents" reference Nishida, "4,685,582" should be --4,635,582--.

Column 6, line 47, Claim 1, "said" should be --and--.

Column 7, line 1, Claim 5, "inlet" should be --intake--.

Column 7, line 36, Claim 9, after "pipe" insert --for exhausting gases from said cavity, said exhaust vent pipe--.

Signed and Sealed this

Twenty-third Day of March, 1993

*Attest:*

STEPHEN G. KUNIN

*Attesting Officer*

*Acting Commissioner of Patents and Trademarks*